US008973184B2

(12) United States Patent
Edgren

(10) Patent No.: US 8,973,184 B2
(45) Date of Patent: Mar. 10, 2015

(54) SKIRT FOR A CRIB OR MATTRESS

(71) Applicant: Danielle Elizabeth Edgren, Winchester, CA (US)

(72) Inventor: Danielle Elizabeth Edgren, Winchester, CA (US)

( * ) Notice: Subject to any disclaimer, the term of this patent is extended or adjusted under 35 U.S.C. 154(b) by 0 days.

(21) Appl. No.: 13/954,671

(22) Filed: Jul. 30, 2013

(65) Prior Publication Data

US 2014/0033429 A1 Feb. 6, 2014

Related U.S. Application Data

(60) Provisional application No. 61/679,632, filed on Aug. 3, 2012.

(51) Int. Cl.
*A47C 21/00* (2006.01)
*A47G 9/02* (2006.01)

(52) U.S. Cl.
CPC ..... *A47G 9/0292* (2013.01); *A47G 2200/106* (2013.01)
USPC ..... 5/493; 5/498; 160/123; 160/124

(58) Field of Classification Search
CPC ..... A47G 9/0292; A47G 11/007; A47G 9/00; Y10S 5/923; Y10S 5/907; A47C 21/022; A47C 31/10; A47C 21/00; A47C 21/02; A47C 31/02; A47C 31/123; A47B 97/00
USPC ..... 5/493, 496, 498, 499, 502, 659; 160/123–124
See application file for complete search history.

(56) References Cited

U.S. PATENT DOCUMENTS

| | | | | | |
|---|---|---|---|---|---|
| 2,245,779 | A * | 6/1941 | Heil | 5/499 |
| 2,763,875 | A * | 9/1956 | Piontkowski | 5/493 |
| 3,001,578 | A * | 9/1961 | Ratliff | 160/126 |
| 4,141,097 | A * | 2/1979 | Levinsohn et al. | 5/493 |
| 4,787,366 | A * | 11/1988 | Bell | 126/500 |
| 4,878,259 | A * | 11/1989 | Lupo | 5/675 |
| 5,070,551 | A * | 12/1991 | Harrison et al. | 4/608 |
| 5,287,614 | A * | 2/1994 | Ehrlich | 29/450 |
| 5,524,689 | A * | 6/1996 | Clark | 160/124 |
| 5,621,931 | A * | 4/1997 | Hamilton | 5/493 |
| 5,733,397 | A * | 3/1998 | McDaniel | 156/66 |
| 5,749,110 | A * | 5/1998 | Gamble et al. | 5/493 |
| 5,802,637 | A * | 9/1998 | Bordo | 5/493 |
| 7,168,113 | B1 * | 1/2007 | Olsen | 5/493 |
| 7,930,779 | B2 * | 4/2011 | Marrache | 5/498 |
| 2008/0229491 | A1 * | 9/2008 | Gregory | 4/558 |
| 2009/0193585 | A1 * | 8/2009 | Winn | 5/498 |
| 2011/0284172 | A1 * | 11/2011 | Seitz | 160/123 |

* cited by examiner

*Primary Examiner* — William Kelleher
*Assistant Examiner* — Myles Throop
(74) *Attorney, Agent, or Firm* — Plager Schack LLP

(57) ABSTRACT

A bedding skirt is configured to be rapidly inserted upon a mattress frame. The bedding skirt includes a front panel sufficiently long to hang from the mattress frame to ground. A back panel is attached to the front panel and sufficiently long to hang from the mattress frame to the ground. A plurality of magnets are attached to the back panel and configured to connect the bedding skirt to the mattress frame. The bedding skirt can be rapidly connected to the mattress frame for use and rapidly removed from the mattress frame for cleaning.

5 Claims, 4 Drawing Sheets

SKIRT FOR A CRIB OR MATTRESS

RELATED APPLICATION

This application claims priority to provisional patent application U.S. Ser. No. 61/679,632 filed on Aug. 3, 2012, the entire contents of which is herein incorporated by reference.

BACKGROUND

The embodiments herein relate generally to bedding. In particular, embodiments of the present invention relate to bedding that can cover a crib or mattress.

Prior to embodiments of the disclosed invention, installing a skirt onto a crib or bed, maintaining the position of the skirt, and removing the skirt have evaded a simple solution. Prior art solutions included hook and loop fasteners and snaps, while this maintains the position of the skirt, they create difficulties in installing and removing the skirt. Embodiments of the present invention solve these problems

SUMMARY

A bedding skirt is configured to be rapidly inserted upon a mattress frame. The bedding skirt includes a front panel sufficiently long to hang from the mattress frame to ground. A back panel is attached to the front panel and sufficiently long to hang from the mattress frame to the ground. A plurality of magnets are attached to the back panel and configured to connect the bedding skirt to the mattress frame. The bedding skirt can be rapidly connected to the mattress frame for use and rapidly removed from the mattress frame for cleaning.

In some embodiments, an upper portion of the front panel is mechanically coupled to a stretch fabric which further holds the bedding skirt to the mattress frame. The stretch fabric can be a two-way stretch fabric that stretches in one direction from selvedge to selvedge. The front panel can also be mechanically coupled to the plurality of magnets.

In some embodiments, the plurality of magnets as spaced at a twelve inch interval. The plurality of magnets can also be neodymium magnets.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
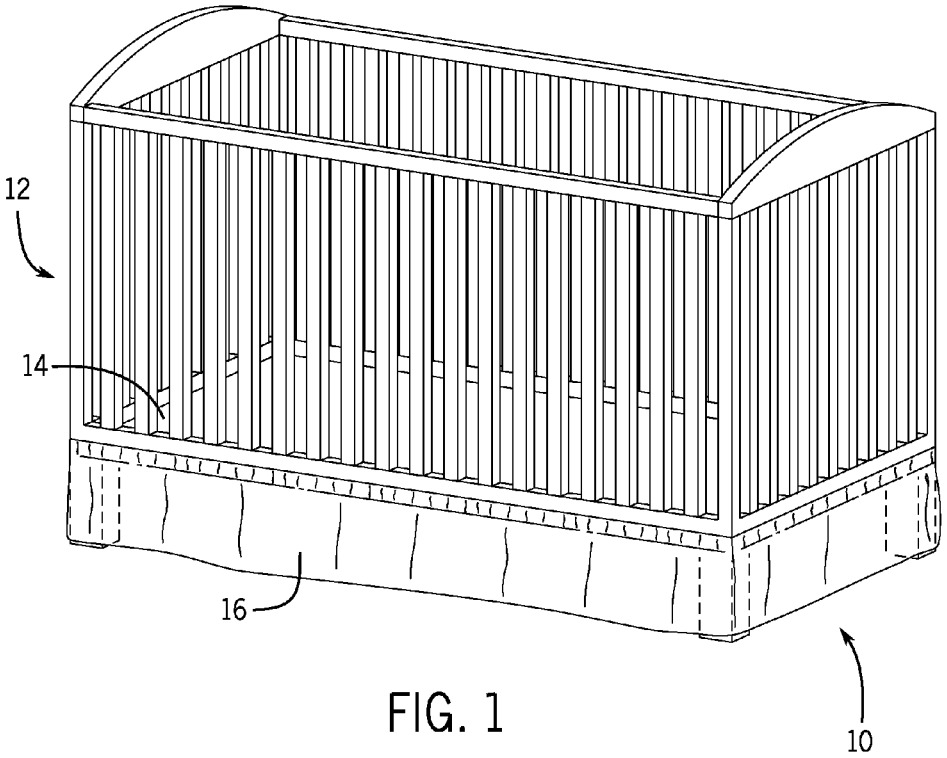
FIG. 1 is a perspective view of an embodiment of the invention in use.
Figure 5:
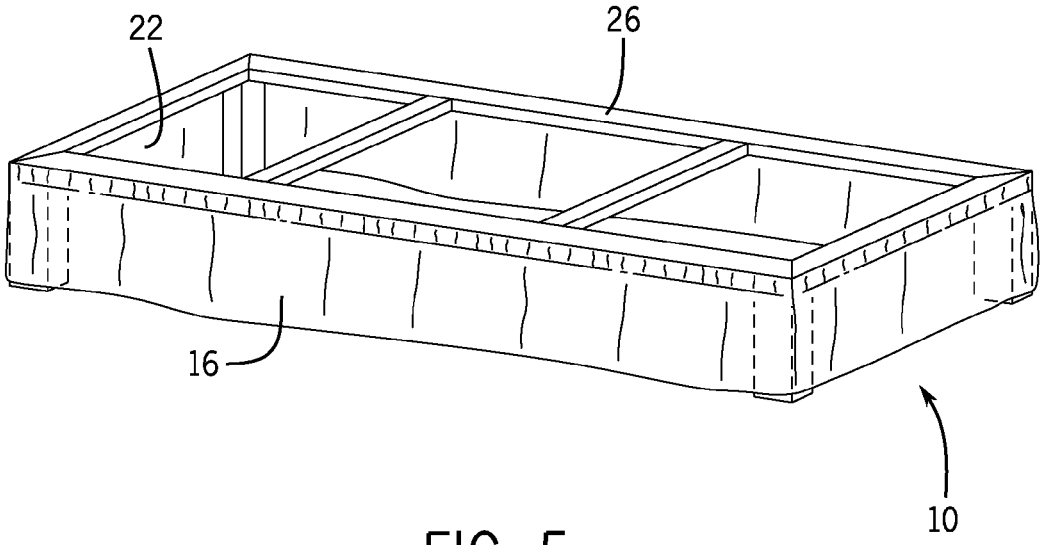
FIG. 5 is a perspective view of an embodiment of the invention in use on a standard bedframe.

By way of example, and referring to FIG. 1, bedding skirt 10 can be used on crib 12 to cover mattress frame 14 such that an upper portion of front panel 16 hangs downward from mattress frame 14 terminating in a lower portion. Front panel 16 should be sufficiently long to hang from mattress frame 14 to ground. In some embodiments, this distance is a few inches, but could be longer. Mattress frame 14 should contain sufficient ferrous material in order for magnets 20 (shown below) to cause bedding skirt 10 to adhere to crib 12. In this embodiment, bedding skirt 10 would be a crib skirt. However bedding skirt 10 can also be used as a bedframe skirt as shown in FIG. 5.

Figure 2:
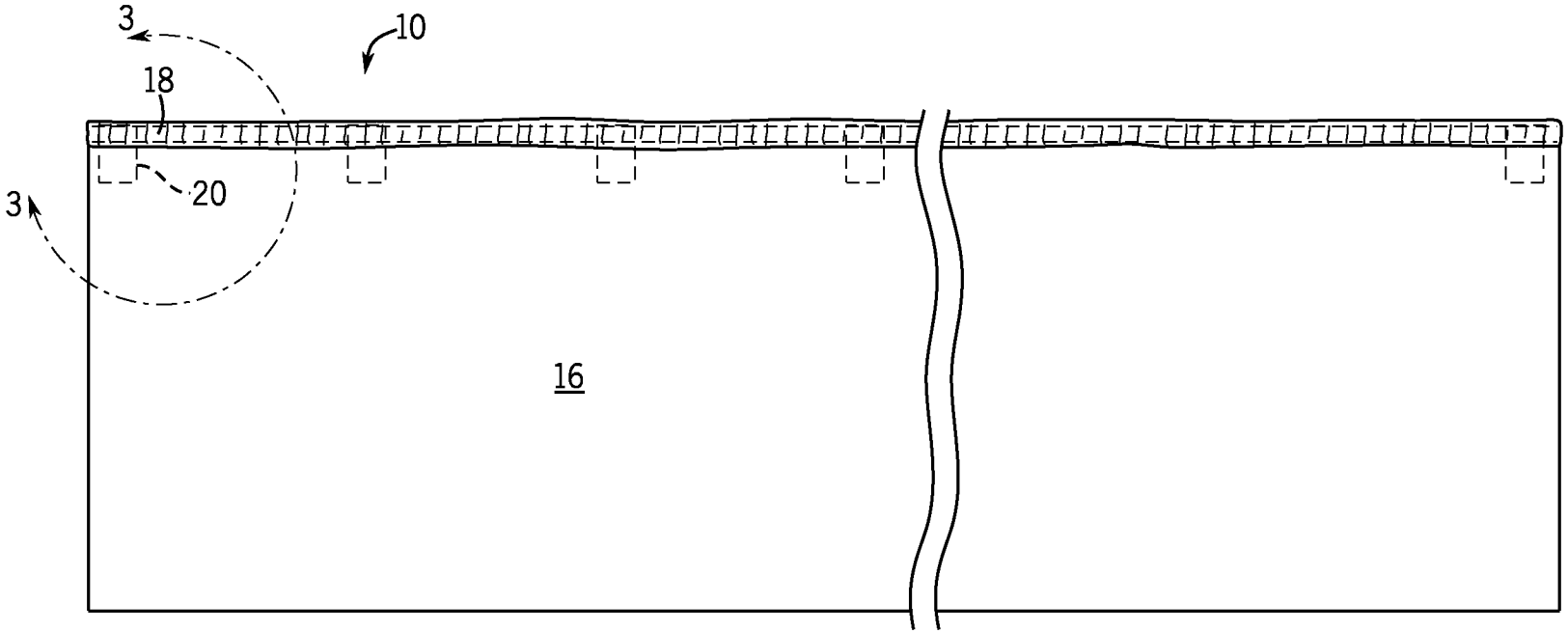
FIG. 2 is a front elevation view of an embodiment of the invention.

Turning to FIG. 2, bedding skirt 10 comprises front panel 16. The upper portion of front panel 16 is mechanically coupled to stretch fabric 18. In some embodiments, stretch fabric 18 is a two-way stretch fabric that stretches in one direction from selvedge to selvedge as shown in FIG. 4.

Figure 3:
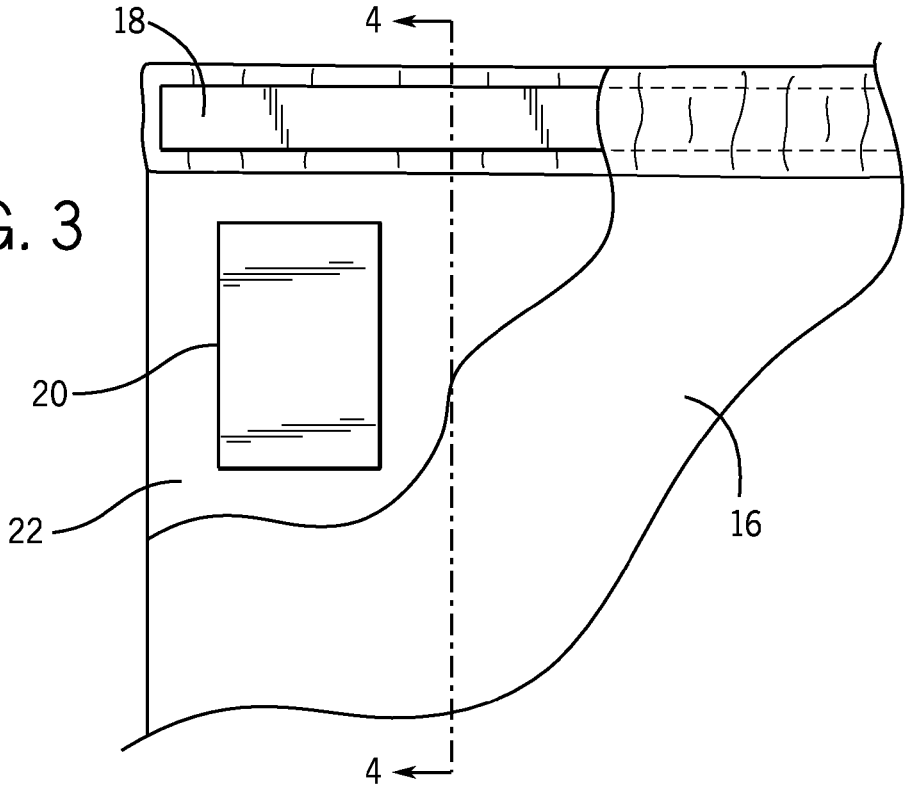
FIG. 3 is a detail elevation view with parts broken away.

In one embodiment, shown in FIG. 3, the back side of front panel 16 is mechanically coupled to back panel 22. Back panel 22 is mechanically coupled to a plurality of magnets 20. However, the construction is not exclusive.

Magnets 20 can be neodymium magnets that are commonly used by hobbyists in model power craft, but have no precedent use in home furnishings. Magnets 20 can be spaced at any interval, however, for standard metal mattress frames, placing magnets 20 at intervals of twelve inches has been found to be effective. In this embodiment a first magnet would be spaced twelve inches from a second magnet, and so on. This is known as spacing at a twelve inch interval. However, this interval is not exclusive of others that could be found effective by those of ordinary skill in the art. This configuration allows a user to rapidly place bedding skirt 10 to mattress frame 14 for use and rapidly remove bedding skirt 10 from mattress frame 14 for cleaning. As used in this application "rapidly" means within ten to thirty seconds. To contrast, using hook and loop fasteners bedding materials takes five to seven minutes.

Figure 4:
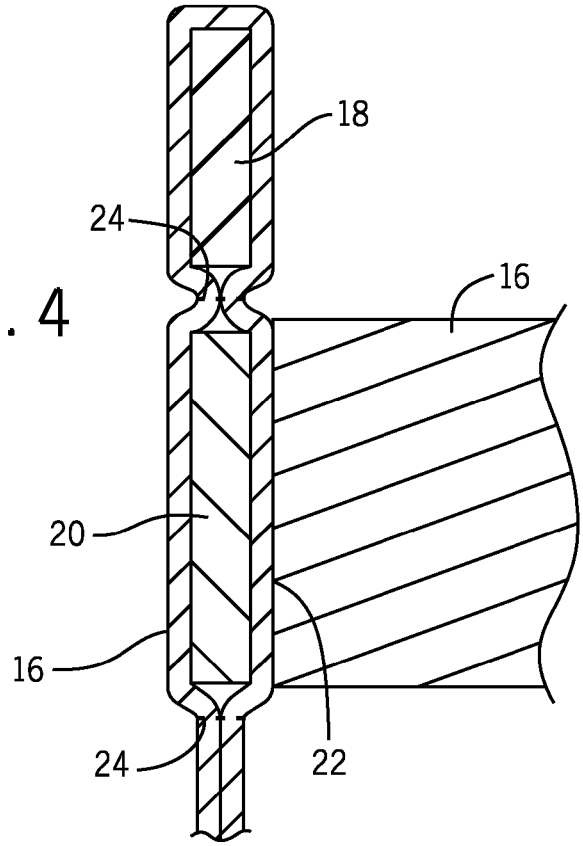
FIG. 4 is a cross-sectional view taken by line 4-4 of FIG. 3.

As shown in FIG. 4, front panel 13 is immediately adjacent to magnet 20. Magnet 20 is immediately adjacent to back panel 22. Front panel 16 is mechanically coupled to back panel 22 with stitching 24 above and below magnet 20. Above stitching 24 front panel 16 wraps over stretch fabric 18 and meets back panel 22.

FIG. 5 shows another use of an embodiment of bedding skirt 10 on a standard bedframe 26. Standard bedframe 26 should contain sufficient ferrous material in order for magnets 20 (shown above) to cause bedding skirt 10 to adhere to standard bedframe 26.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A bedding skirt configured to be rapidly inserted upon a ferrous material mattress frame, the bedding skirt comprising:

a front panel sufficiently long to hang from the ferrous material mattress frame to ground;

a back panel mechanically coupled to the front panel and sufficiently long to hang from the ferrous material mattress frame to the ground;

a plurality of magnets sewn between the front panel and the back panel such that the front panel and the back panel entirely surround each magnet and the plurality of magnets operate to adhere the bedding skirt to the ferrous material mattress frame;

wherein the bedding skirt is configured to be rapidly connected to the ferrous material mattress frame for use and rapidly removed from the ferrous material mattress frame for cleaning; wherein an upper portion of the front panel is mechanically coupled to a stretch fabric which further holds the bedding skirt to the mattress frame.

2. The bedding skirt of claim 1, wherein the stretch fabric is a two-way stretch fabric that stretches in one direction from selvedge to selvedge.

3. The bedding skirt of claim 1, wherein the front panel is mechanically coupled to the plurality of magnets.

4. The bedding skirt of claim 1, wherein the plurality of magnets are spaced at a twelve inch interval.

5. The bedding skirt of claim 1, wherein the plurality of magnets are neodymium magnets.

* * * * *